US006135826A

United States Patent [19]

Kovach

[11] Patent Number: 6,135,826

[45] Date of Patent: Oct. 24, 2000

[54] SURFACE MOUNTABLE HOUSING FOR ELECTRICAL COMPONENTS AND WIRING CONNECTIONS

[75] Inventor: John M. Kovach, Coram, N.Y.

[73] Assignee: Pittway Corp., Chicago, Ill.

[21] Appl. No.: 09/295,161

[22] Filed: Apr. 20, 1999

[51] Int. Cl.[7] ..... H01R 9/22

[52] U.S. Cl. ..... 439/718; 174/138 F

[58] Field of Search ..... 439/142, 467, 439/521, 595, 596, 718; 714/138 F

[56] References Cited

U.S. PATENT DOCUMENTS

| | | | |
|---|---|---|---|
| 4,127,315 | 11/1978 | Mckee | 339/103 |
| 4,210,888 | 7/1980 | Holce | 335/207 |
| 4,213,110 | 7/1980 | Holce | 335/207 |
| 4,335,270 | 6/1982 | Holce et al. | 335/202 |
| 4,409,577 | 10/1983 | Holce et al. | 335/202 |
| 4,789,348 | 12/1988 | Hampton | 439/142 |
| 5,291,553 | 3/1994 | Smith | 379/399 |
| 5,476,397 | 12/1995 | Leff et al. | 439/727 |
| 5,879,173 | 3/1999 | Poplawski et al. | 438/138 |
| 6,010,343 | 1/2000 | Konoya et al. | 439/144 |

*Primary Examiner*—Neil Abrams
*Assistant Examiner*—Thanh-Tam Le
*Attorney, Agent, or Firm*—Greenberg Traurig, LLP; Anthony R. Barkume

[57] ABSTRACT

A hinged covered surface mountable housing for electrical components such as a magnetic reed switch, having an internal conductor channel and a plurality of routing paths with access means for routing an electrical conductor therethrough. The electrical status of the component is not impacted as a result of an accidental or intended opening or removal of the housing cover.

18 Claims, 3 Drawing Sheets

SURFACE MOUNTABLE HOUSING FOR ELECTRICAL COMPONENTS AND WIRING CONNECTIONS

BACKGROUND OF THE INVENTION

The present invention relates to protective housings for electrical components and wiring connections as typically used in security systems, CCTV, and access control circuits utilizing an improved housing with an internal conductor channel and improved conductor access means.

DESCRIPTION OF THE PRIOR ART

Security systems typically utilize a series of components strategically placed around the protected premises where each component is wired into a central system. One such component is a magnetic reed switch. Prior art housings for magnetic reed switches have been made of metal or plastic and may have an integral hinge or may be of multi-part construction consisting of a base and cover. U.S. Pat. No. 4,335,270 describes a housing made of plastic having an integral hinge wherein a magnetic reed switch may be placed inside the cover with wire access through one end of the enclosure. The housing may be mounted to a surface by the use of adhesives or fasteners such as nails or screws. In this housing the switch lies inside the cover and the short leads from the component must be spliced into the rest of the system. This type of housing must be connected to the system by attaching an electrical conductor via a splice necessitating a solder joint or equivalent connection, then covering the joint with an insulating material. Replacement of a faulty unit requires the time consuming tasks of cutting the old connection; removing the faulty component; replacing the component or removing and replacing the housing with the old component; soldering or joining a new component followed by the covering the splice with insulating material.

U.S. Pat. No. 4,409,577 presents another type of magnetic reed switch housing having a modified enclosure to contain the switch. In this enclosure, the switch is restrained within the enclosure and terminals have been added to enable simple installation and connection to the system. The leads of a two wire conductor must be separated then the insulation must be removed. The separate leads are then externally routed to the ends of the housing and inserted through apertures located on one side of the enclosure where the terminal connections have been located. Screws are engaged to lock the electrical conductors in place. While this has been an improvement over the '270 patent in the replaceability of the housing and internal components, the separation of the wires and external routing to the aperture opening does not provide a neat appearance, and the wires may separate further if the wire is pulled or strained. The installation of this unit requires the attachment of the base to a surface. The cover of the '577 unit contains the electronic component and is attached to the base by an integral hinge. If the housing inadvertently opens due to vibration or thermal expansion of the housing material, a signal may be generated by the movement of the sensor with respect to the matching component. For example, if the component is a reed switch, the sudden opening of the cover would cause the switch to change state due to a change in magnetic field or position. This would cause a false alarm condition to be generated in the alarm system. Additionally, this arrangement requires excess wire located near the housing in order to allow the cover to rotate to the open or closed position, potentially leading to an increased likelihood of having an unkempt installation. Orientation of the unit is also limited by the wiring access requirements for the side aperture locations.

U.S. Pat. No. 5,476,397 describes a multipart housing where the terminal clamps have been moved closer together and a modified clamp has been defined to capture the electrical conductor leads. No stripping of the insulation of the electrical conductor is required since the new clamps cut through the insulation. The clamp location reduces the amount of separation required of the electrical conductor wire leads and the access apertures for the electrical conductor are aligned with the terminal clamp openings on the side of the housing. The orientation of the housing is constrained by the wire access requirement of the side wall location of the apertures.

What is desired therefore is an improved housing having an aesthetically pleasing external shape where an unseparated electrical conductor may enter the enclosure from any orientation. The wires would then be internally routed within the enclosure thorough access channels for connection to the terminal connectors. The visible separation of the wires, which in the prior art was external to the enclosure, would occur inside the enclosure. It is also desirable to have an alarm sensor housing with a protective cover that conceals the electrical connections, fasteners and electrical conductors. It is also desirable to have a sensor housing that may be opened by an installer or serviceman for troubleshooting purposes, without changing the state of the component or affecting the circuit.

SUMMARY OF THE INVENTION

In accordance with these and other objects, the present invention overcomes the aforementioned limitations of the previously known component housings by providing a new housing where the electrical conductor may be preferably routed through one of several strategically located access openings in the enclosure. Upon entering the enclosure the electrical conductor may be internally routed and separated to attach the conductors to the terminal connections. The cover when closed hides the separation of the wire and forms part of a conductor channel for the electrical conductor to be placed therein. The housing of this invention eliminates the potential for generating a false alarm condition due to the cover of the housing moving from its closed position to an opened position, since no electrical components are stored in the cover.

Thus, the present invention is a surface mountable housing for wiring or connecting electrical components comprising a mountable body and a protective cover configured to substantially enclose said mountable body when in a closed position. The mountable body comprises a cavity means for receiving the electrical component, means for mounting the mountable body on a surface, access means for allowing an electrical conductor therethrough, terminal means for connecting an electrical conductor inserted through the access means, and shoulder means for allowing the electrical conductor to be disposed therealong. The protective cover comprises a pair of end walls, a pair of side walls, and a top plate, wherein the first of the side walls forms a conductor channel with the shoulder means when the protective cover is in a closed position, whereby the electrical conductor may be routed through the access means and connected to the terminal means via the conductor channel.

The protective cover may have access means in the side walls substantially in alignment with the access means of the mountable body for routing an electrical conductor therethrough.

The shoulder means projects from the cavity means a distance parallel to the cavity means, such that when the electrical conductor is routed through the conductor channel, and when the protective cover is closed, the side wall contacts the shoulder means and the side wall restrictively engages the electrical conductor between the cavity body and the protective cover.

The mountable body is preferably connected to the protective cover with an integral hinge and latch means. Furthermore, the means for mounting comprises an aperture means suitable for inserting a fastener therethrough.

The access means comprises a plurality of apertures located on the second side wall, and a passageway located at the ends of the cavity means provides a path for the routing of an electrical conductor from the conductor channel to the plurality of apertures.

DETAILED DESCRIPTION OF THE PREFERRED EMBODIMENT

Figure 1:
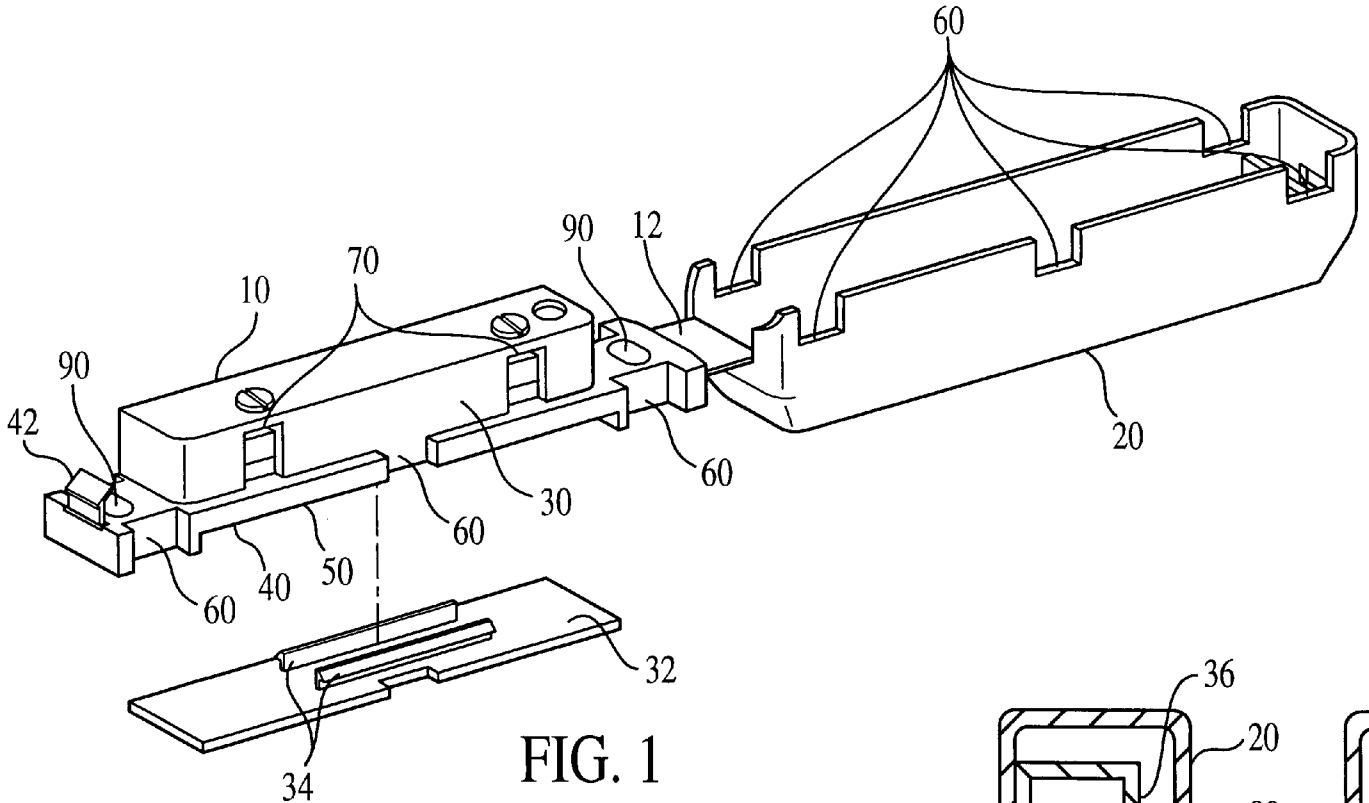
FIG. 1 is an isometric drawing of the preferred embodiment of the present invention in the open position.

With reference to FIG. 1, a surface mountable housing is of one piece construction which has a longitudinal protective cover 20 integrally attached to a mountable body 10 by a living (i.e. integral) hinge 12. The mountable body 10 has a cavity means 30 suitable for containing electrical components such as a magnetic reed switch. A cavity closure 32 is used to secure the cavity means 30 after the electrical component has been located in the cavity. The cavity closure 32 has locking tabs 34 that interact with the interior of the cavity means to form a portion of the mounting surface 40 of the enclosure. In the preferred embodiment, a pair of electrical conductor terminal means 70 are located within the cavity side walls. The specific electrical component of the cavity 30 is not particularly relevant to the invention. The terminal means comprise a clamping surface that applies pressure to the electrical conductor to securely hold the electrical conductor in place while providing a method to allow conductive contact to the electrical component contained in the cavity 30. The mountable body 10 has a mounting surface 40 utilized to removably attach the mountable body 10 to a surface. The mounting surface 40 of the mountable body 10 may have apertures 90 located therethrough whereby fasteners may be used to retain the mountable body in place. Alternatively, adhesive materials such as a double-sided foam strip may be used in place or in addition to the fasteners. In the preferred embodiment the housing is made of a flexible synthetic material.

Figure 2:
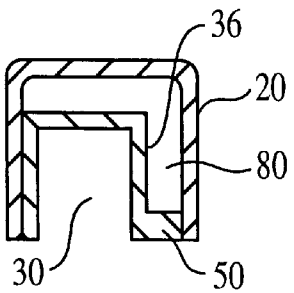
FIG. 2 is a cross-sectional view of the preferred embodiment with shoulder means, with the protective cover in the closed position.

A plurality of access means 60 that define alternative paths for the electrical conductor to pass therethrough from the outside of the housing to the interior of the housing may be located in the mountable body, in the protective cover, or both. In one embodiment of the invention, the access means 60 is restricted by the use of a shoulder means 50 (see FIG. 2) which projects from the cavity 30 and is located on the outside cavity side wall 36.

A conductor channel 80 (see FIG. 2 and 3) is formed when the housing is in the closed position and comprises the interior wall of the protective cover 20, the exterior side wall 36 of the cavity 30, and optionally may include the upper surface of the shoulder means 50.

Figure 3:
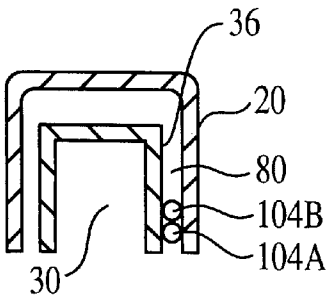
FIG. 3 is a cross-sectional view of another embodiment without shoulder means, with the protective cover in the closed position.
Figure 4:
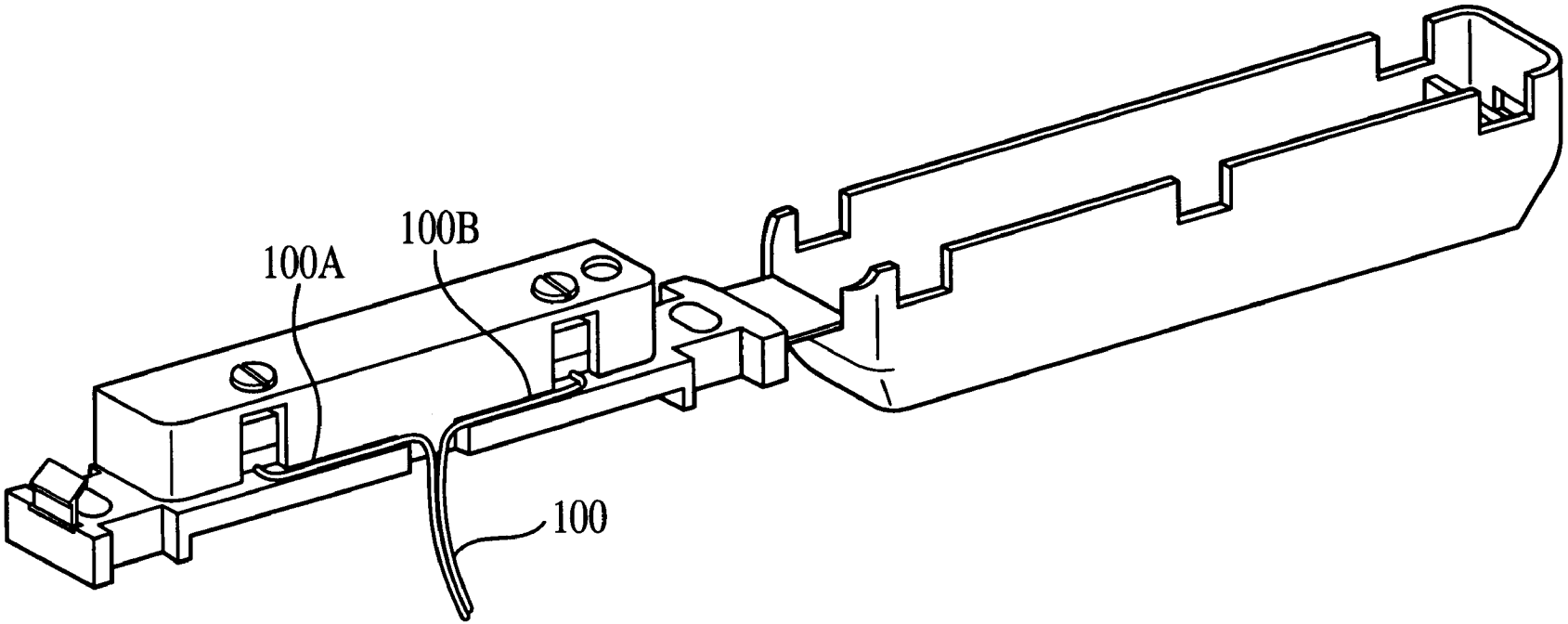
FIG. 4 is an isometric drawing of the preferred embodiment showing the electrical conductor routed through the access means, with the protective cover in the open position.

An electrical conductor 100 may be routed through any of the access means 60, through the conductor channel 80 and connected to the terminal means 70. FIG. 4 shows how an installed electrical conductor 100 would look with the cover 20 in the open position. FIG. 3 shows the electrical conductor 104A, 104B in the conductor channel held in place between the interior wall of the protective cover 20 and the exterior wall 36 of the cavity means. In the preferred embodiment, the separation of the leads 100A, 100B is located within the conductor channel of the housing adjacent to the cavity 30 of the mountable body 10 to allow for a more visually attractive installation. Alternatively, in this or any of the following embodiments delineated, the leads of the electrical conductor may not be separated within the housing when terminal connections are not used, but may instead pass into the cavity means where they are connected to the electrical component contained therein. Prior art housings had the electrical conductors separated and attached to the terminals where it would be likely that the conductor leads would separate due to normal wear or strain, leading to an overall sloppy appearance. When the cover of the housing of this invention is in a closed condition, if the electrical conductor is pulled, it is unlikely that the conductor leads would separate from each other since the leads are held close to each other by the access means as they enter the housing. Another embodiment has the distance between the cover 20 and the cavity side wall 36 such that the electrical conductor 100 (see FIG. 3) is restrictively engaged between the two surfaces, thereby acting to further prevent separation of the leads and reduce strain at the terminal means 70.

In another embodiment, the electrical component may have leads pre-attached to the component that are routed through the cavity base or walls. The leads are connected to an electrical conductor inside the housing using a joining method such as solder. The electrical conductor would then be routed through the access means to attach to the system.

Figure 5:
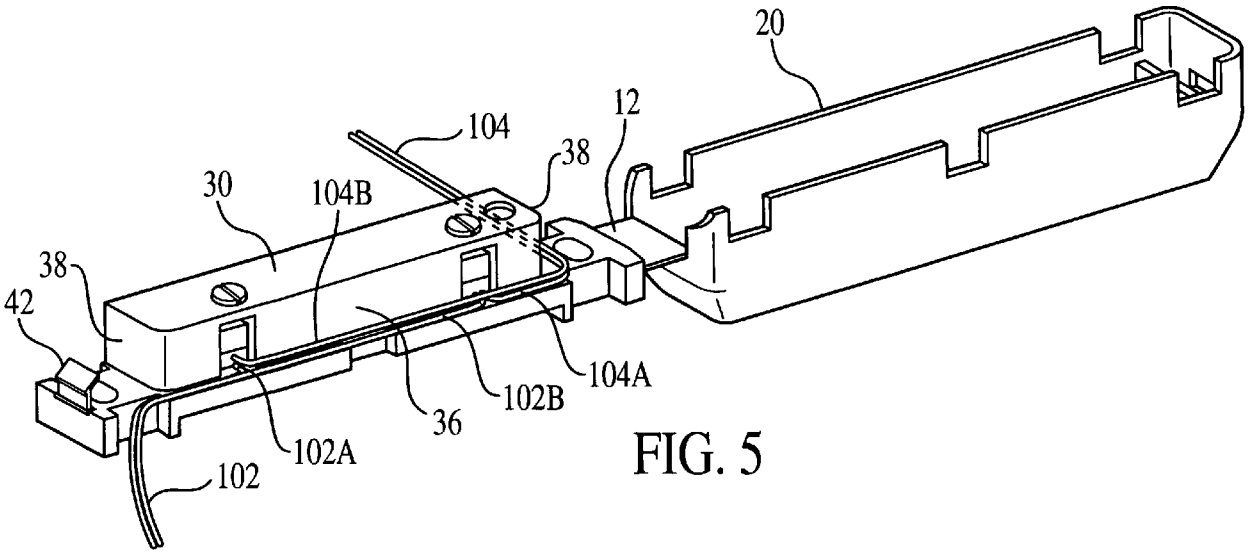
FIG. 5 is an isometric drawing of the preferred embodiment showing several alternate electrical conductor routing paths, with the protective cover in the open position.

FIG. 5 shows alternative electrical conductor routing paths 102, 104. In the preferred embodiment, the electrical conductor is routed via the shortest path to the terminal connections. The electrical conductor 102 demonstrates one routing path and attaches to the housing components via the separated conductors 102A, 102B and exits the housing through an aperture near one of the ends. The electrical conductor 104 shows how the conductor may also be routed around the cavity end wall 38 where the conductor leads 104A, 104B separate inside the housing to attach to the electrical component stored in the cavity. In the preferred embodiment, only one of the electrical conductors 102 or 104 would be connected to the terminal leads, but it is possible that several electrical conductors (i.e. 102 and 104) could be routed into this housing simultaneously. Since the housing of this design has a plurality of access openings and a flexible routing path through the conductor channel 80, the housing location and wiring path may be optimally chosen to achieve the most visually appealing installation.

Figure 6:
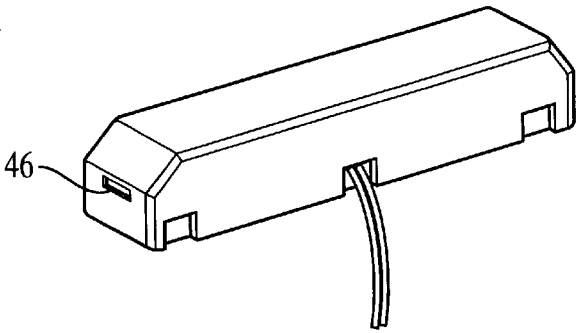
FIG. 6 is an isometric drawing of the preferred embodiment showing the electrical conductor routed through one of the access means, with the protective cover in the closed position.
Figure 7:
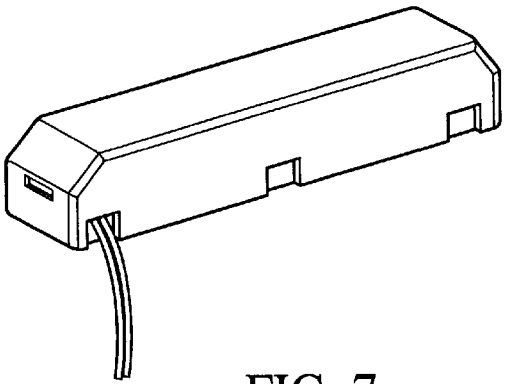
FIG. 7 is an isometric drawing of the preferred embodiment showing an alternate electrical conductor routing, with the protective cover in the closed position.

FIGS. 6 and 7 show how the housing appears in the preferred embodiment of this invention with the protective cover 20 in the closed position. The housing is closed by rotating the cover 20 about the flexible hinge 12 joining the cover 20 to the mountable body 10. As the cover 20 closes, the electrical conductor is held in place to allow the electrical conductor to pass through the access means of the cover or base. The cover near the hinge end has a relief area for the hinge. Once the cover is moved to a closed position a close contact area is achieved between the cover and the mountable body near the hinge end. The latch member 42 engages the aperture 46 in the cover to secure the cover to the mountable body. Other locking mechanisms may be used to achieve the same result.

Since the electrical component is enclosed in the cavity body of the mountable housing of this invention and all electrical conductors are attached to the components once the mountable housing is located, the opening and closing of the cover does not move the electrical components contained in the housing. This is advantageous throughout the life of the housing and the encased electrical components where the circuit connections may be easily inspected and tested by an installer or serviceman without adversely impacting the state of the electrical component or circuit status.

In another embodiment the electrical component housing may be used to contain an actuator magnet or other component which does not require wiring.

What is claimed is:

1. A surface mountable housing for electrical components comprising:

a) a mountable body comprising:
- i) a cavity means for receiving said electrical component,
- ii) means for mounting said mountable body on a surface,
- iii) access means for allowing an electrical conductor therethrough,
- iv) terminal means for connecting an electrical conductor inserted through said access means,
- v) shoulder means for allowing said electrical conductor to be disposed therealong;

b) a protective cover configured to substantially enclose said mountable body when in a closed position, said protective cover comprising:
- i) pair of end walls,
- ii) a pair of side walls,
- iii) a top plate,
  - wherein the first of said side walls forms a conductor channel with said shoulder means when said protective cover is in a closed position, whereby when the cover is in an open position said electrical conductor may be routed through said access means and connected to said terminal means via said conductor channel.

2. The surface mountable housing of claim 1 wherein said protective cover has aperture means in the side walls substantially in alignment with said access means for routing an electrical conductor therethrough.

3. The surface mountable housing of claim 1 wherein the shoulder means of said mountable body projects from the cavity means a distance parallel to the cavity means, such that when said electrical conductor is routed through the conductor channel, when the protective cover is closed, said side wall contacts the shoulder means, the side wall restrictively engaging the electrical conductor between the cavity body and the protective cover.

4. The surface mountable housing of claim 1 wherein the mountable body is connected to the protective cover with an integral hinge and latch means.

5. The surface mountable housing of claim 1 wherein the means for mounting comprises an aperture means suitable for inserting a fastener therethrough.

6. The surface mountable housing of claim 5 where in the aperture means for mounting is elliptically shaped.

7. The surface mountable housing of claim 5 wherein the aperture means for mounting restrictively engages the fastener such that it is held in place while the surface mountable housing is located and the fasteners are installed.

8. The surface mountable housing of claim 1 wherein the access means comprises a plurality of apertures located on the second side wall, and a passageway located at the ends of the cavity means provides a path for the routing of an electrical conductor from the conductor channel to the plurality of apertures.

9. The surface mountable housing of claim 1 further comprising a reed switch mounted in the cavity means of the mountable body whereby the reed switch will not change state through inadvertent or intended opening or separation of the protective cover.

10. A surface mountable housing for electrical components comprising:

a) a mountable body comprising:
- i) a cavity means for receiving said electrical component,
- ii) means for mounting said mountable body on a surface,
- iii) means for connecting an electrical conductor,
- iv) shoulder means for allowing said electrical conductor to be disposed therealong;

b) a protective cover configured to substantially enclose said mountable body when in a closed position, said protective cover comprising:
- i) pair of end walls,
- ii) a pair of side walls,
- iii) a top plate,
- iv) access means for allowing an electrical conductor therethrough,
  - wherein the first of said side walls forms a conductor channel with said shoulder means when said protective cover is in a closed position, said electrical conductor routed through said access means, whereby when the cover is in an open position said electrical conductor may be routed through said conductor channel and connected to said connecting means via said conductor channel.

11. The surface mountable housing of claim 10 wherein said mountable body has aperture means in the shoulder means substantially in alignment with said cover access means for routing an electrical conductor therethrough.

12. The surface mountable housing of claim 10 wherein the shoulder means of said mountable body projects from the cavity means a distance parallel to the cavity means, such that when said electrical conductor is routed through the conductor channel, when the protective cover is closed, said side wall contacts the shoulder means, the side wall restrictively engages the electrical conductor between the cavity body and the protective cover.

13. The surface mountable housing of claim 10 wherein the mountable body is connected to the protective cover with an integral hinge and latch means.

14. The surface mountable housing of claim 10 wherein the means for mounting comprises an aperture means suitable for inserting a fastener therethrough.

15. The surface mountable housing of claim 14 where in the aperture means for mounting is elliptically shaped.

16. The surface mountable housing of claim 14 wherein the aperture means for mounting restrictively engages the fastener such that it is held in place while the surface mountable housing is located and the fasteners are installed.

17. The surface mountable housing of claim 10 wherein the access means comprises a plurality of apertures located on the second side wall, and a passageway located at the ends of the cavity means provides a path for the routing of an electrical conductor from the conductor channel to the plurality of apertures.

18. The surface mountable housing of claim 10 further comprising a reed switch mounted in the cavity means of the mountable body whereby the reed switch will not change state through inadvertent or intended opening or separation of the protective cover.

* * * * *